US007254979B2

(12) United States Patent
Lüthi et al.

(10) Patent No.: US 7,254,979 B2
(45) Date of Patent: Aug. 14, 2007

(54) DEVICE FOR EJECTION OF MOULDED PIECES FROM A MOULDING TOOL

(75) Inventors: Rudolf Lüthi, Niederwangen (CH); Daniel Meier, Schmitten (CH)

(73) Assignee: Adval Tech HOLDING AG, Niederwangen (CH)

( * ) Notice: Subject to any disclaimer, the term of this patent is extended or adjusted under 35 U.S.C. 154(b) by 142 days.

(21) Appl. No.: 10/495,026

(22) PCT Filed: Nov. 19, 2002

(86) PCT No.: PCT/CH02/00622

§ 371 (c)(1),
(2), (4) Date: May 10, 2004

(87) PCT Pub. No.: WO03/043759

PCT Pub. Date: May 30, 2003

(65) Prior Publication Data

US 2004/0255636 A1 Dec. 23, 2004

(30) Foreign Application Priority Data

Nov. 22, 2001 (CH) ..... 2156/01

(51) Int. Cl.
*B21J 13/14* (2006.01)

(52) U.S. Cl. ..... 72/344; 72/427

(58) Field of Classification Search ..... 72/344, 72/345, 346, 427
See application file for complete search history.

(56) References Cited

U.S. PATENT DOCUMENTS

| | | | | | |
|---|---|---|---|---|---|
| 445,238 | A | * | 1/1891 | Beach | 72/344 |
| 1,721,283 | A | * | 7/1929 | Ruth | 72/198 |
| 1,977,163 | A | * | 10/1934 | Wilcox | 470/197 |
| 2,227,524 | A | * | 1/1941 | Williams | 72/353.4 |
| 2,329,325 | A | * | 9/1943 | Berry | 72/344 |
| 3,555,874 | A | * | 1/1971 | Kuhn | 72/257 |
| 3,620,113 | A | | 11/1971 | Gargrave | |
| 3,911,719 | A | | 10/1975 | Degenhardt et al. | |
| 4,887,448 | A | * | 12/1989 | Kooi et al. | 72/344 |

FOREIGN PATENT DOCUMENTS

| | | |
|---|---|---|
| CH | 295 447 A | 12/1953 |
| DE | 11 42 149 B | 1/1963 |
| DE | 40 28 425 A1 | 3/1992 |

* cited by examiner

*Primary Examiner*—Dmitry Suhol
(74) *Attorney, Agent, or Firm*—Sughrue Mion, PLLC

(57) ABSTRACT

The invention relates to a so-called spring cushion (5), for the ejection of moulded pieces (4) from a moulding tool (3), with a plunger (6), moving in a guide tube (9) within the moulding tool and loaded in the ejection direction (14) by means of a spring (15). According to the invention, the spring (15) is embodied as a draw spring, in particular as a spiral draw spring. Considerably longer service life can be achieved as draw springs do not have radial deflections on loading.

3 Claims, 1 Drawing Sheet

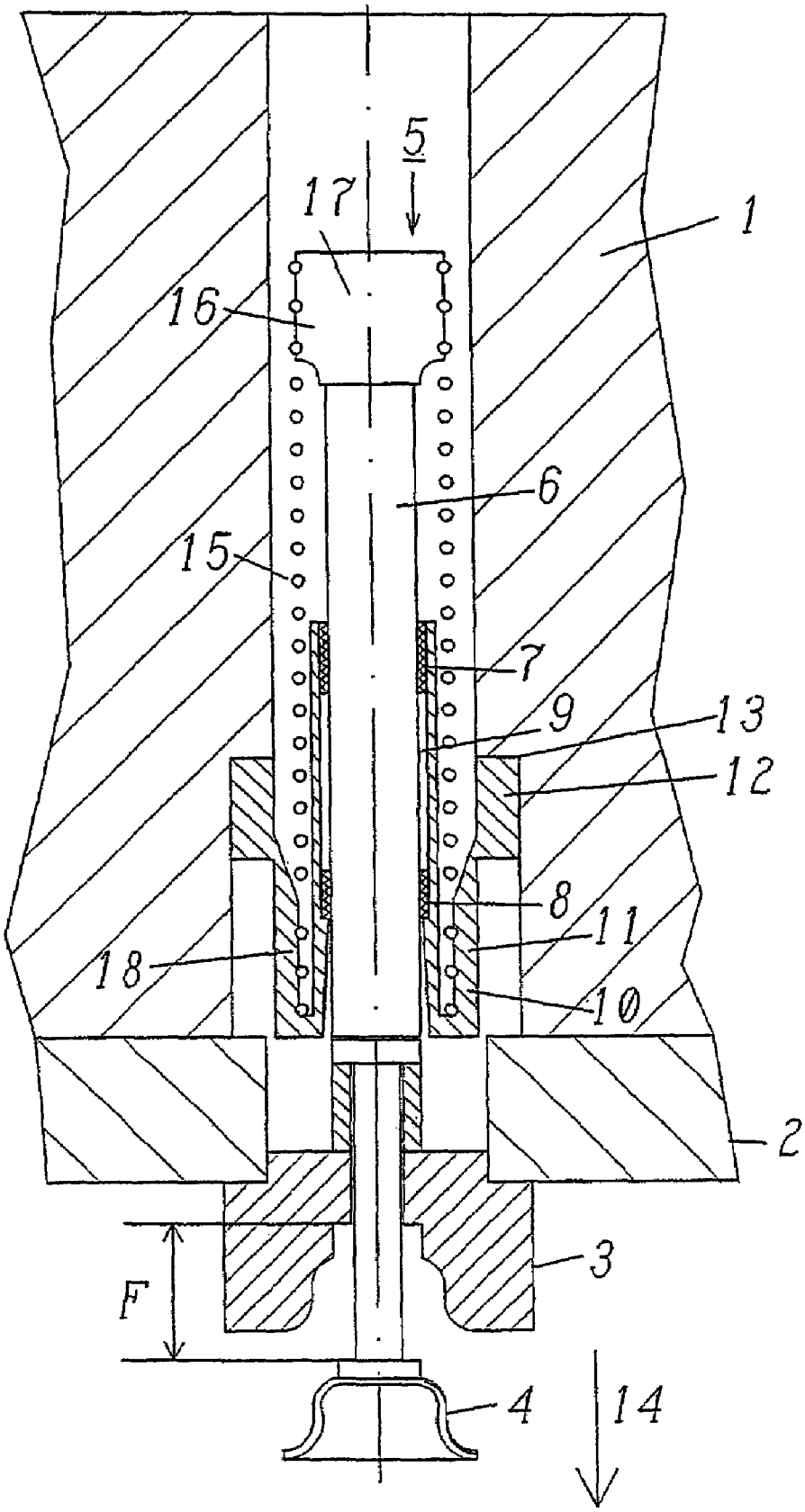
5
17
1
16
6
15
7
9
13
12
8
11
18
10
2
3
F
4
14

DEVICE FOR EJECTION OF MOULDED PIECES FROM A MOULDING TOOL

TECHNICAL FIELD

The present invention relates to a device for ejecting formed parts, in particular those made of sheet metal, from a forming die, having a plunger movably guided in the forming die in a guide tube and loaded in the ejection direction by a spring.

PRIOR ART

Such devices are known and are also designated as spring cushions. The springs used in such spring cushions are generally compression springs.

The forming die may be, for example, a multistage compound die, consisting of a top part and a bottom part, in a press. In this case, the top part is fitted into the press ram and performs stroke movements together with the latter. Modern presses run with high stroke rates of several hundred strokes per minute. Between each stroke, the parts to be formed must be reliably ejected, for example, from the top part. Production figures of 100 million pieces per year are not uncommon. Under such conditions, it has been possible hitherto to achieve a tool life of about ⅓ year on average. In this case, the wear or the failure of the spring cushions has proved to be a limiting factor.

DESCRIPTION OF THE INVENTION

The object of the invention, inter alia, is to specify a device for ejecting formed parts from a forming die, having a plunger movably guided in the forming die in a guide tube and loaded in the ejection direction by a spring, this device being distinguished by a longer service life. According to the invention, this object is achieved in such a device by a tension spring being used as the spring.

The invention is based on the knowledge that the compression springs used hitherto in the spring cushions tend to deflect radially as soon as they are compressed and that the deflection can become so large that the spring touches the guide tube. This results in metallic abrasion and ultimately leads to the failure of the spring cushion. By a tension spring being used according to the invention instead of a compression spring, this problem is advantageously avoided and a longer service life is achieved in the sense of the object specified.

According to a first preferred embodiment of the invention, a helical spring is used as the tension spring and in such a way that the guide tube and the plunger are arranged essentially inside this helical spring.

According to a further preferred embodiment, to attach the spring to the guide tube and to the plunger, screw plugs are provided in each case on the guide tube and on the plunger, into which screw plugs are screwed into the spring ends.

The tension spring is extended under loading. However, the spring wire, with regard to its pitch, is fixed on the two screw plugs. In the transition region from the screw plugs to the free region, this results in a jump in pitch and stress under loading, with unequal loading of the spring wire in torsion. In order to alleviate this nonuniformity of the spring loading and prolong the life of the spring, provision is made according to yet a further embodiment of the invention for the pitch of the thread on the screw plugs to be dimensioned in accordance with an average spring pitch, the expression "average spring pitch" referring to the pitch of the spring in a center position of the plunger between its two end positions.

With spring cushions according to the present invention, it has been possible to achieve a tool life of at least one year at said production rates.

BRIEF EXPLANATION OF THE FIGURES

The invention is to be explained in more detail below with reference to exemplary embodiments in connection with the drawing. The drawing shows a section through a spring cushion according to the invention in the fitted state.

WAYS OF IMPLEMENTING THE INVENTION

In the drawing, 1 designates the ram of a press, which itself is not shown. The top part, fastened to the ram 1, of a forming die is designated by 2, the actual forming die is designated by 3, an already formed sheet-metal part is designated by 4, and a spring cushion according to the invention inserted into a stepped bore in the press ram 1 is designated by 5.

The spring cushion 5 in turn comprises a plunger 6 which is displaceable in its longitudinal direction in two sliding guides 7 and 8. The sliding guides 7, 8 are arranged on the inside on a guide tube 9. The guide tube 9 is part of a type of sleeve 10 which also has an outer tube 11. The outer tube 11 leads into a flange 12 which is secured to a step 13 of the abovementioned stepped bore.

The plunger 6 of the spring cushion 5 is preloaded in the ejection direction, identified by arrow 14, by a helical tension spring 15 which is directed around the plunger 6 on the outside. The top end section 16 of the spring 15 is screwed onto a plug 17 and the bottom end section 18 of the spring 15 is screwed onto the guide tube 9 onto or into the annular gap between guide tube 9 and outer tube 11 of the sleeve 10. The guide tube 9 and the outer tube 11 or the sleeve 10 thus likewise constitute a type of bottom plug for the spring 15.

The drawing shows the spring cushion plunger 6 in its fully extended bottom end position, in which the spring 15 is loaded to the smallest extent and therefore has only a small pitch along its center region, where it is free. If the plunger 6, during the closing of the die, is pressed upward by the spring travel F into its top end position, the spring 15 is loaded to the maximum extent and obtains the maximum pitch in its free region. Of course, in a plunger position at precisely half the distance between the two end positions, the spring 15 has an average pitch. The spring 15 is secured to the two plugs by the thread. As a result, the pitch of the spring 15 does not change here at the transition between the two end positions. In order to preserve the spring and keep the difference in pitch between its center free section and its two end sections as small as possible on average, the pitch on the end sections is selected to be approximately equal to the abovementioned average pitch.

LIST OF DESIGNATIONS

| | |
|---|---|
| 1 | Ram of a press |
| 2 | Top part of a forming die |
| 3 | A forming die |
| 4 | An already formed sheet-metal part |
| 5 | Spring cushion |
| 6 | Plunger |
| 7, 8 | Sliding guides |
| 9 | Guide tube |
| 10 | Sleeve |
| 11 | Outer tube |
| 12 | Flange |
| 13 | Step |
| 14 | Arrow |
| 15 | Helical tension spring |
| 16 | Top end section |
| 17 | Plug |
| 18 | Bottom end section |

The invention claimed is:

1. A device for ejecting formed parts from a forming die having a plunger movably guided in the forming die in a guide tube and loaded in the ejection direction by a spring wherein, the spring is a tension spring, and wherein the tension spring is a helical spring, wherein the guide tube and the plunger are arranged essentially inside this helical spring.

2. The device as claimed in claim 1, wherein, to attach the spring to the guide tube and to the plunger, screw plugs are provided in each case on the guide tube and on the plunger, the screw plugs each being screwed into ends of the spring ends.

3. The device as claimed in claim 2, wherein the spring, in a center position of the plunger, has an average pitch, and wherein the pitch of the thread on the screw plugs in each case corresponds to this average spring pitch.

* * * * *